US011302154B2

(12) United States Patent
Paik et al.

(10) Patent No.: US 11,302,154 B2
(45) Date of Patent: Apr. 12, 2022

(54) AUTOMATED TELLER MACHINE HAVING A SLIDABLE UNLOADING UNIT HAVING A BELT PART

(71) Applicant: HYOSUNG TNS INC., Seoul (KR)

(72) Inventors: Seung Tae Paik, Seoul (KR); Sung Ho Park, Seoul (KR); Seung Soo Lee, Seoul (KR)

(73) Assignee: HYOSUNG TNS INC., Seoul (KR)

( * ) Notice: Subject to any disclaimer, the term of this patent is extended or adjusted under 35 U.S.C. 154(b) by 25 days.

(21) Appl. No.: 16/955,461

(22) PCT Filed: Dec. 7, 2018

(86) PCT No.: PCT/KR2018/015542
§ 371 (c)(1),
(2) Date: Jun. 18, 2020

(87) PCT Pub. No.: WO2019/124840
PCT Pub. Date: Jun. 27, 2019

(65) Prior Publication Data

US 2020/0372765 A1 Nov. 26, 2020

(30) Foreign Application Priority Data

Dec. 22, 2017 (KR) ..... 10-2017-0178691

(51) Int. Cl.
*G07F 19/00* (2006.01)
*G07D 11/40* (2019.01)
*G07D 11/16* (2019.01)

(52) U.S. Cl.
CPC ..... *G07F 19/205* (2013.01); *G07D 11/16* (2019.01); *G07D 11/40* (2019.01)

(58) Field of Classification Search
CPC ..... G07F 19/20; G07F 19/205; G07D 11/14; G07D 11/16; G07D 11/40
(Continued)

(56) References Cited

U.S. PATENT DOCUMENTS

2007/0001367 A1* 1/2007 Lee ..... G07D 11/14 271/10.01

FOREIGN PATENT DOCUMENTS

JP 2004-145895 A 5/2004
JP 2014-006599 A 1/2014
(Continued)

OTHER PUBLICATIONS

International Search Report dated Mar. 4, 2019.
Korean Office Action dated Dec. 11, 2018 issued in corresponding Korean Patent Appln. No. 10-2017-0178691.

*Primary Examiner* — Suezu Ellis
(74) *Attorney, Agent, or Firm* — Bacon & Thomas, PLLC

(57) ABSTRACT

An automated teller machine includes a frame on which a first belt part and a second belt part for conveying a medium are provided, and an unloading unit slidably coupled to the frame and provided with a third belt part for unloading the medium conveyed from the second belt part. The second belt part and the third belt part are configured to form a continuous medium movement path above the first belt part. A separation space is formed between the second belt part and the third belt part in a state in which the unloading unit is slid forward. The first belt part is exposed to an outside of the automated teller machine through the separation space.

11 Claims, 7 Drawing Sheets

(58) Field of Classification Search
USPC ..... 235/379; 194/206; 902/13–15
See application file for complete search history.

(56) References Cited

FOREIGN PATENT DOCUMENTS

| | | | |
|---|---|---|---|
| JP | 2014-123222 | A | 7/2014 |
| KR | 10-2012-0010735 | A | 2/2012 |
| KR | 10-1258286 | B1 | 4/2013 |

* cited by examiner

AUTOMATED TELLER MACHINE HAVING A SLIDABLE UNLOADING UNIT HAVING A BELT PART

TECHNICAL FIELD

The present invention relates to an automated teller machine.

BACKGROUND ART

An automated teller machine is an automated device that can assist in basic financial services, such as deposit or withdrawal, without bank staff regardless of location and time in relation to financial services. In recent years, the automated teller machine has been used for various purposes such as depositing/withdrawing bills, depositing/withdrawing checks, updating bankbooks, paying giro fees, issuing tickets, and the like.

In general, an automated teller machine may include a cassette module for storing a medium such as a bill or the like, and a medium unloading part for unloading the medium stored in the cassette module to the user.

A conveyance belt for conveying a medium may be provided inside the medium unloading part. From the viewpoint of space efficiency, the medium movement path defined by the conveyance belt may be formed to be layered in the vertical direction.

In the case of the automated teller machine in which the medium movement path is layered in the vertical direction as described above, when a medium is jammed in the medium movement path formed on the lowermost side, there is an inconvenience that the automated teller machine as a whole has to be disassembled to remove the jammed medium.

Accordingly, there is a need for a study on an automated teller machine capable of removing a jammed medium with ease.

DETAILED DESCRIPTION OF THE INVENTION

Technical Problem

Embodiments of the present invention provide an automated teller machine capable of easily removing a medium when the medium is jammed in a movement path during conveyance thereof.

Technical Solution to the Problem

In accordance with a first embodiment of the present invention, there is provided an automated teller machine, including: a frame on which a first belt part and a second belt part for conveying a medium are provided; and an unloading unit slidably coupled to the frame and provided with a third belt part for unloading the medium conveyed from the second belt part, wherein the second belt part and the third belt part are configured to form a continuous medium movement path above the first belt part, a separation space is formed between the second belt part and the third belt part in a state in which the unloading unit is slid forward, and the first belt part is exposed to an outside of the automated teller machine through the separation space.

The frame may include: a body portion in which the first belt part and the second belt part are provided; and a guide portion coupled at one end of the guide portion to both side surfaces of the body portion and protruding at the other end of the guide portion to an outside of the body portion, the guide portion having guide slits formed on both side surfaces of the guide portion.

The unloading unit may be inserted into and slidably coupled to the guide portion, and may include guide protrusions provided on both side surfaces of the unloading unit and inserted into the guide slits to move along the guide slits.

The guide slits may extend in a longitudinal direction of the guide portion, and at least a portion of each of the guide slits is convexly curved upward at one end side of the guide portion.

Locking members may be provided to protrude from both inner surfaces of the body portion, and a hook portion detachably coupled to the locking members is provided at one end of the unloading unit.

The hook portion may include: a shaft member rotatably connected at both ends to the inner surfaces of the unloading unit; hooks provided at both ends of the shaft member and rotated together with the shaft member during rotation of the shaft member to be fastened to or separated from the locking members; and a grip portion fixedly coupled to the shaft member.

The hook portion may further include an elastic member configured to apply a rotational force so that the shaft member maintains a constant position.

At least a portion of the third belt part may be provided to overlap with the second belt part when seen in a vertical direction of the automated teller machine before a sliding movement of the unloading unit, and the third belt part may be provided so as to be spaced apart from the second belt part after the sliding movement of the unloading unit.

The frame may further include an elevating part in which the medium passing through the first belt part is accumulated, and the medium introduced into the first belt part may be accumulated in the elevating part and then unloaded through the second belt part and the third belt part.

The elevating part may be rotatable upwardly and downwardly, and is configured to rotate upwardly to guide the medium to the second belt part when the accumulation of the medium introduced along the first belt part is completed.

The machine may further include: at least one cassette configured to store the medium; and a cassette module configured to supply the medium to the frame.

In accordance with a second embodiment of the present invention, there is provided an automated teller machine, including: a first belt part configured to convey, one by one, a medium discharged from at least one cassette in which the medium is stored; a second belt part configured to convey the medium conveyed from the first belt part and loaded in the form of a bundle; and a third belt part connected to the second belt part and configured to convey the medium to a user, wherein the third belt part is movable between a first position where at least a portion of the third belt part overlaps with the second belt part in a vertical direction and a second position where the third belt part is spaced apart from the second belt part.

Advantageous Effects of the Invention

According to the automated teller machine of one embodiment of the present invention, it is possible to easily remove a medium when the medium is jammed in a movement path.

BEST MODE FOR CARRYING OUT THE INVENTION

Figure 1:
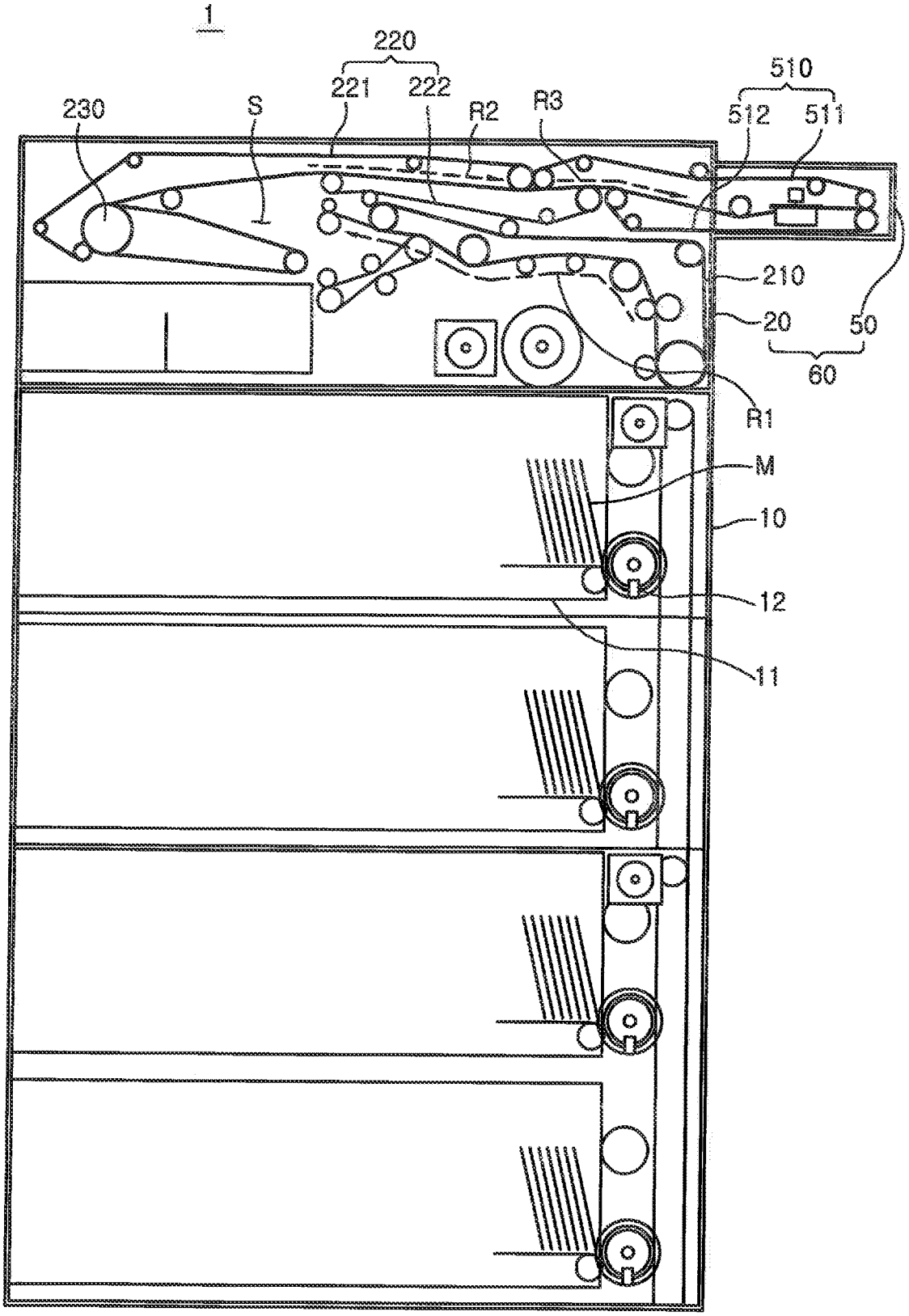
FIG. 1 is a schematic sectional view of an automated teller machine according to one embodiment of the present invention.

While the foregoing has described what are considered to be the best mode and/or other examples based on the principle that the inventor can properly define his own invention as the concept of the term, the terms and words used in the specification and claims described below shall not be interpreted in a conventional or dictionary sense, but shall be interpreted in terms of meaning and concepts conforming to the technical spirit of the present invention. Therefore, since the embodiments described in the specification and the configurations shown in the drawings are only the most preferred embodiments of the present invention, and do not represent all of the technical spirit of the present invention, it should be understood that there may be various equivalents and variations that could substitute them at the time of the present application.

Hereinafter, preferable embodiments of the present invention will be described in detail with reference to the accompanying drawings. Further, a detailed description of the known function and configuration that may obscure the gist of this invention will be omitted. For the same reason, some components in the drawings are exaggerated, omitted or schematically illustrated, and the size of each component does not exactly reflect its actual size.

FIG. 1 is a schematic sectional view of an automated teller machine according to one embodiment of the present invention.

Referring to FIG. 1, the automated teller machine 1 according to one embodiment of the present invention may include a cassette module 10 in which a medium is accommodated, and a medium unloading part 60 coupled to an upper portion of the cassette module 10.

The cassette module 10 is a module for storing a medium to be unloaded, and may include at least one cassette 11 and a conveyance belt 12 for conveying the medium unloaded from the cassette 11 to the medium unloading part 60.

At least one cassette 11 may be provided. If there is provided a plurality of cassettes 11, they may be disposed in the vertical direction or in the horizontal direction. Media M may be accumulated inside the cassette 11. Meanwhile, the conveyance belt 12 may be disposed on one side of the cassette 11. The conveyance belt 12 may convey the medium so that the medium discharged from the cassette 11 is introduced into the medium unloading part 60. For example, the conveyance belt 12 may be disposed in front of the cassette 11 and may convey the medium discharged from the cassette 11 to the medium unloading part 60 provided on the upper side. At this time, the conveyance belt 12 may be operated by being connected to a separate driving source (not shown).

The medium unloading part 60 may be provided on one side of the cassette module 10. The medium introduced into the medium unloading part 60 by the conveyance belt 12 may be unloaded to the user by the medium unloading part 60. For example, the medium introduced into the medium unloading part 60 may be accumulated in an accumulation space S above an elevating part 230 through a first path R1 defined by a first belt part 210. Thereafter, the upward rotational operation of the elevating part 230 is performed. When the upward rotational operation of the elevating part 230 is completed, the medium is conveyed through a second path R2 defined by a second belt part 220. The medium may be finally delivered to the user through a third path R3 defined by a third belt part 510.

Hereinafter, the detailed configuration of the medium unloading part 60 provided in the automated teller machine 1 according to one embodiment of the present invention will be described with additional reference to FIGS. 2 to 7.

Figure 2:
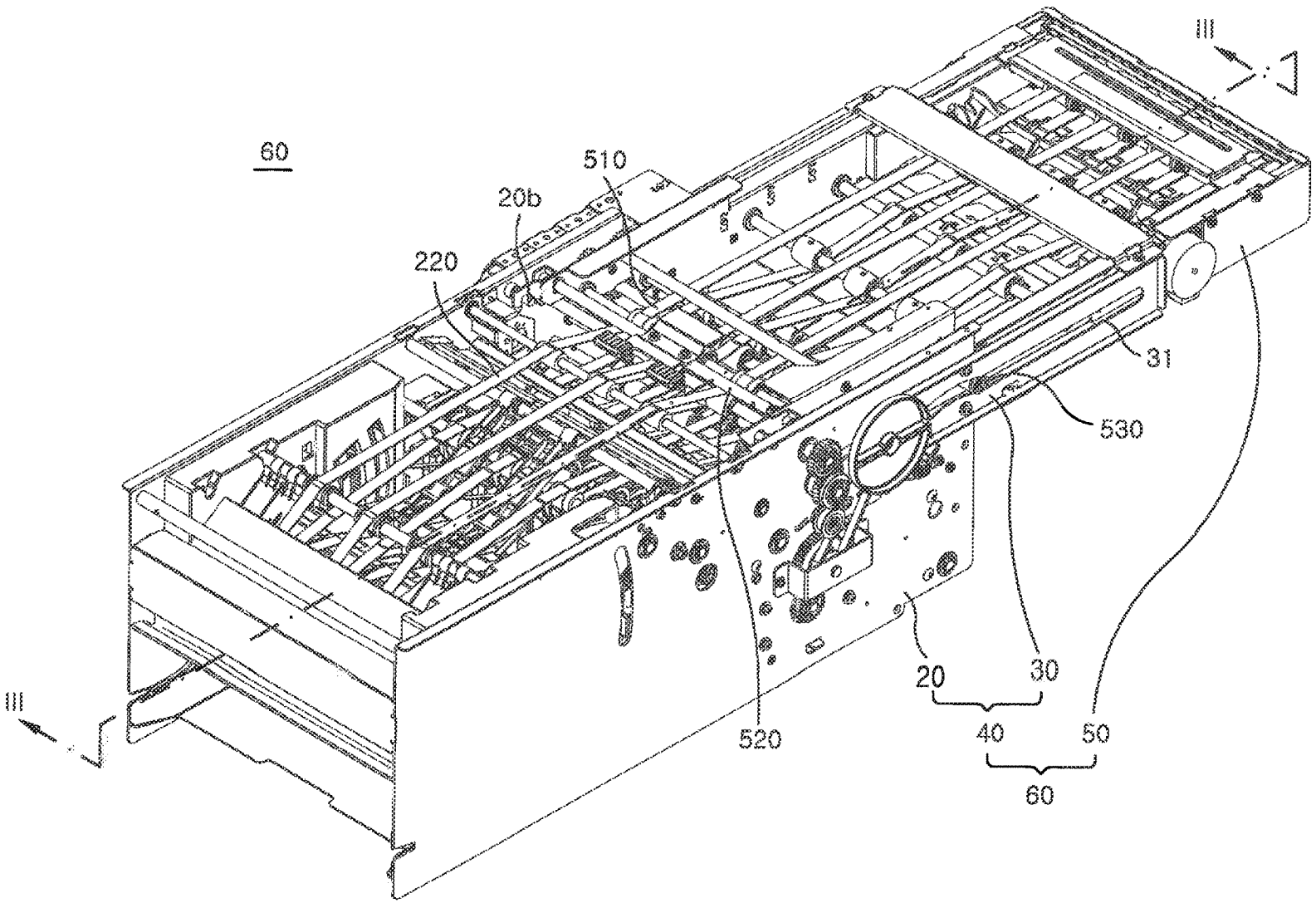
FIG. 2 is a schematic perspective view showing a state before an unloading unit is slidingly moved in a medium unloading part according to one embodiment of the present invention.
Figure 3:
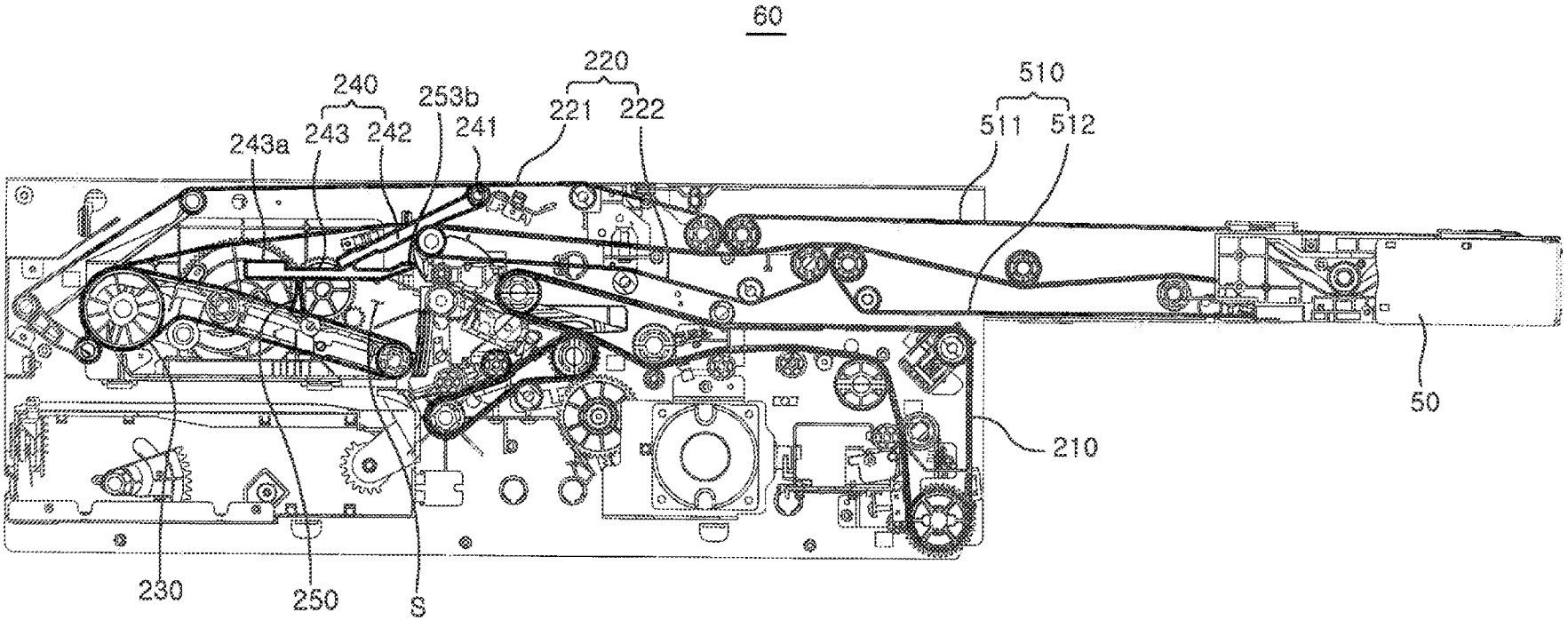
FIG. 3 is a schematic sectional view taken along line III-III in FIG. 2.
Figure 4:
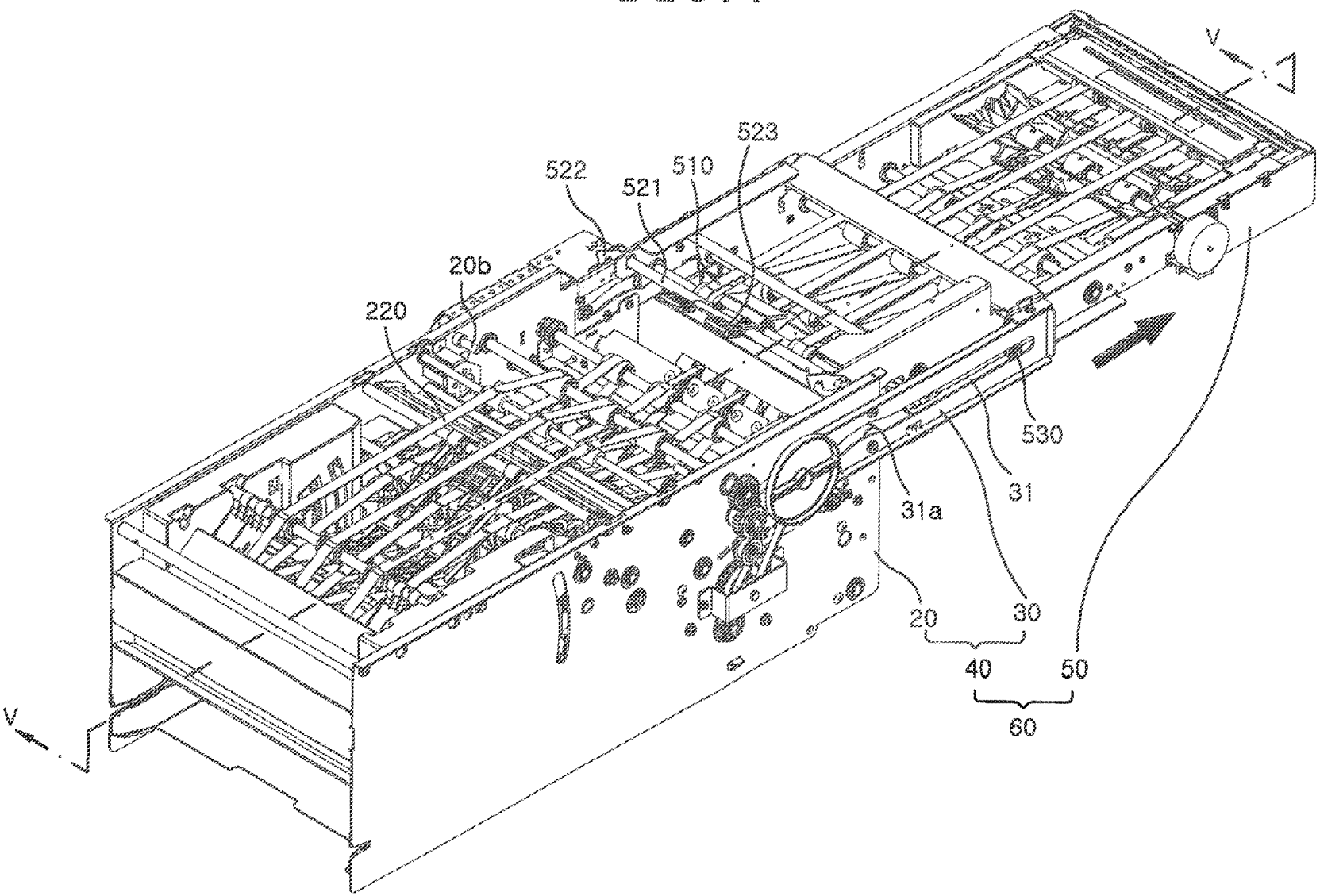
FIG. 4 is a schematic perspective view showing a state after the unloading unit is slidingly moved in the medium unloading part according to one embodiment of the present invention.
Figure 5:
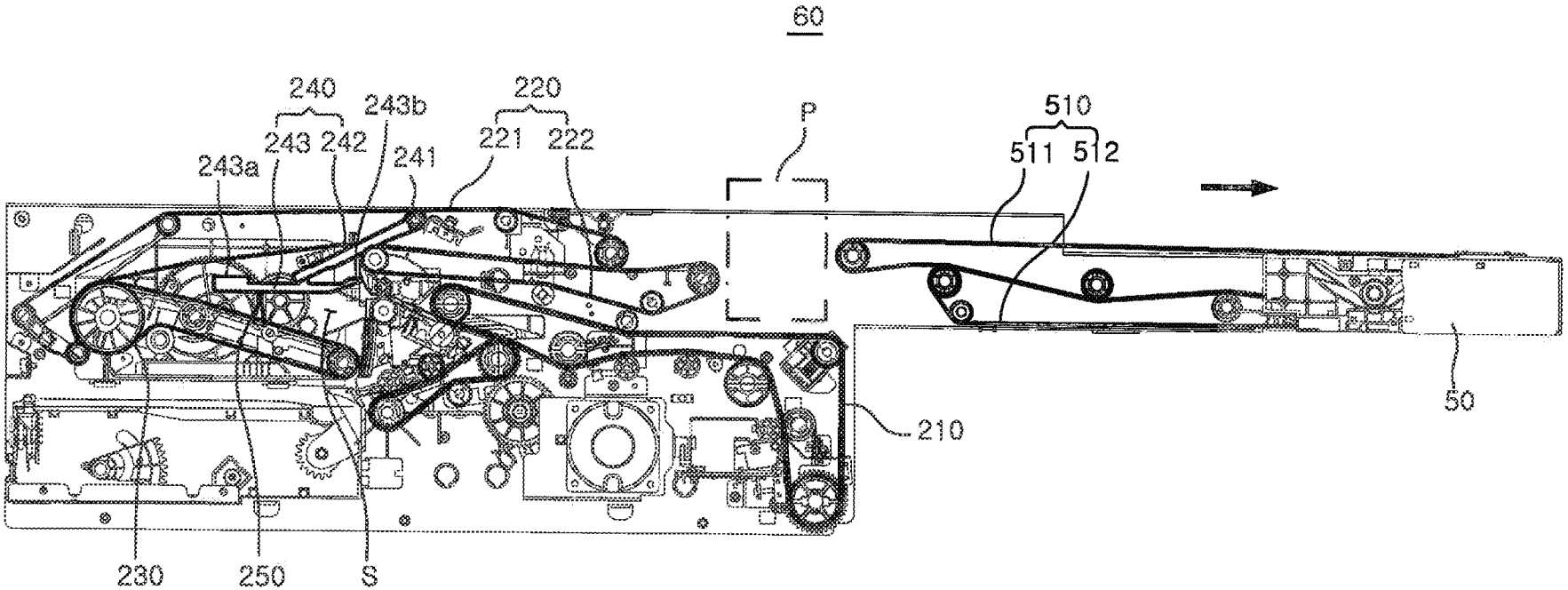
FIG. 5 is a schematic sectional view taken along line V-V in FIG. 4.
Figure 6:
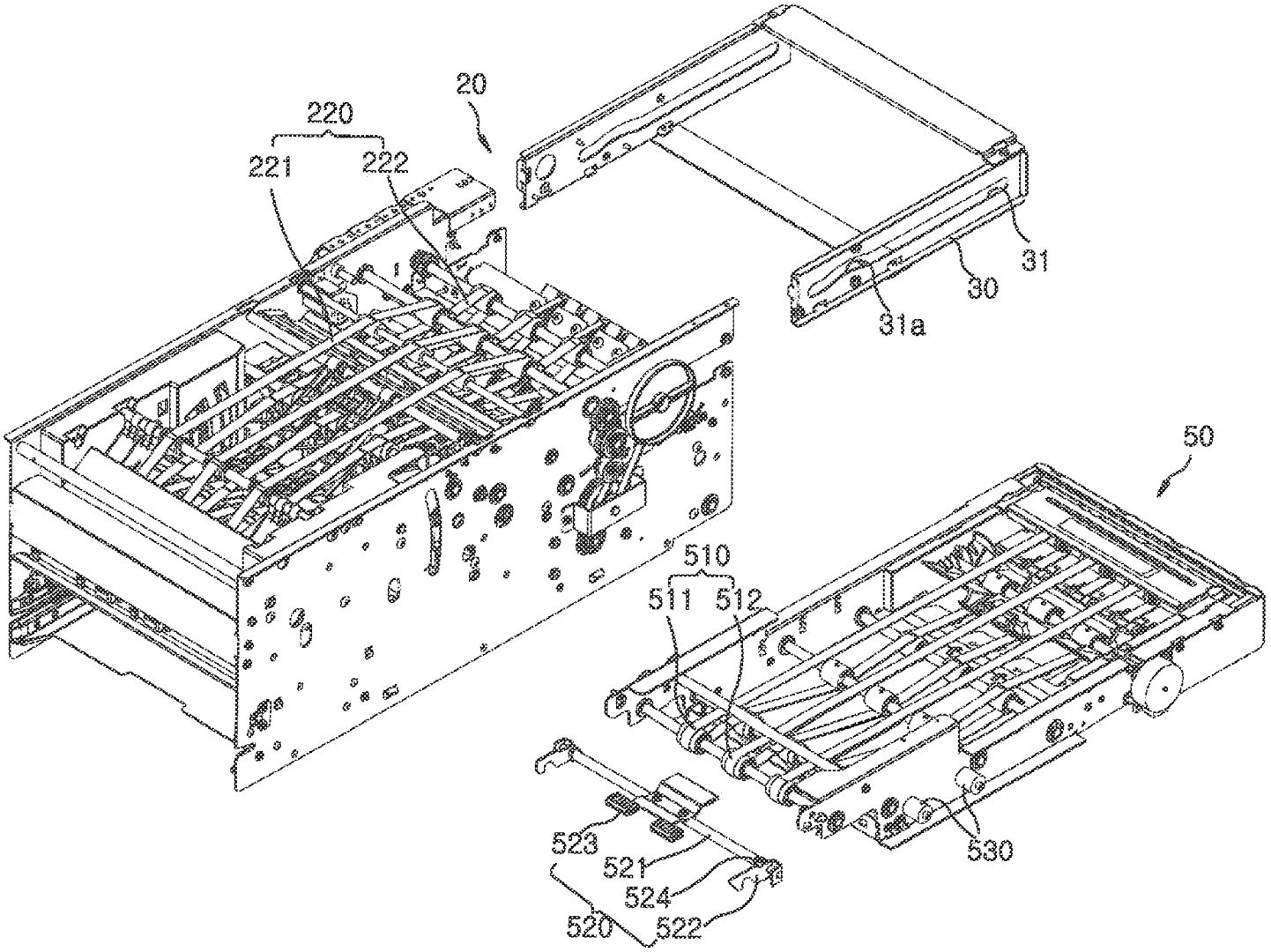
FIG. 6 is a schematic exploded perspective view of the medium unloading part according to one embodiment of the present invention.
Figure 7:
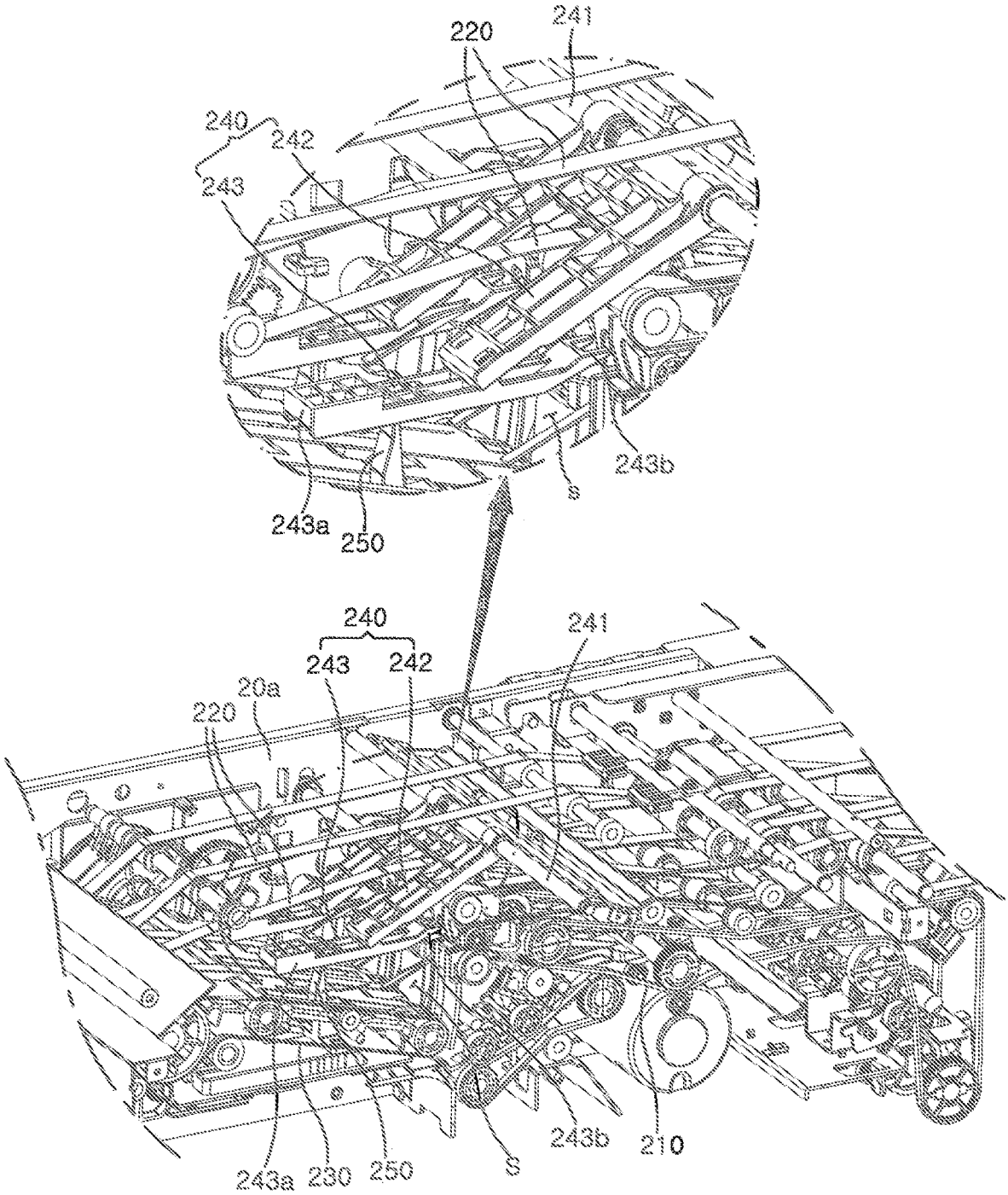
FIG. 7 is a schematic partial cut-away view of the medium unloading part according to one embodiment of the present invention.

FIG. 2 is a schematic perspective view showing a state before the unloading unit is slidingly moved in the medium unloading part according to one embodiment of the present invention. FIG. 3 is a schematic sectional view taken along line III-III in FIG. 2. FIG. 4 is a schematic perspective view showing a state after the unloading unit is slidingly moved in the medium unloading part according to one embodiment of the present invention. FIG. 5 is a schematic sectional view taken along line V-V in FIG. 4. FIG. 6 is a schematic exploded perspective view of the medium unloading part according to one embodiment of the present invention. FIG. 7 is a schematic partial cut-away view of the medium unloading part according to one embodiment of the present invention.

Referring further to FIGS. 2 to 7, the medium unloading part 60 provided in the automated teller machine according to one embodiment of the present invention may include a frame 40 on which the first belt part 210 and the second belt part 220 are provided, and an unloading unit 50 slidably coupled to the frame 40 and provided with the third belt part 510 for unloading the medium introduced from the second belt part 220.

The frame 40 may form an external appearance of the medium unloading part 60. The frame 40 may include a body portion 20 in which the first belt part 210 and the second belt part 220 are provided, and a guide portion 30 coupled at one end to both sides of body portion 20 and protruding out of the body portion 20 at the other end. The guide portion 30 may have guide slits 31 formed to penetrate both side surfaces thereof.

On the body portion 20, there are provided an elevating part 230 capable of rotating and moving up and down and configured to provide an accumulation space S in which the medium is accumulated, a first belt part 210 configured to convey the medium to the accumulation space S, a stack guide 240 disposed above the elevating part 230 so as to press the medium accumulated in the elevating part 230, a second belt part 220 configured to unload the accumulated medium from the elevating part 230, and a stopper 250 provided to penetrate the elevating part 230 so that one end portion penetrating the elevating part 230 comes into contact with the stack guide 240.

The first belt part 210 defines a first path R1 through which the medium is conveyed. The first belt part 210 may guide the medium introduced into the medium unloading part 60 through the conveyance belt 12 to the accumulation space S above the elevating part 230. The first belt part 210 may be provided a plurality of belt members and a plurality of rollers. The configuration of the first belt part 210 may be replaced with various configurations commonly used in the art for conveying a medium.

The medium conveyed by the first belt part 210 may be accumulated on the elevating part 230. In the automated teller machine 1 according to one embodiment of the present invention, the medium may be unloaded in the form of a bundle. The accumulation space S in which the medium can be accumulated may be provided on the elevating part 230.

The elevating part 230 may rotate and move up and down to guide the medium accumulated in the accumulation space S to the second path R2. For example, the elevating part 230 may be provided such that one end thereof is disposed below the end of the first path R1. Therefore, the medium introduced into the accumulation space S one by one through the first belt part 210 may be sequentially accumulated on the upper surface of the elevating part 230 and may be stacked in the form of a bundle while the elevating part 230 is lowered. Subsequently, the elevating part 230 may rotate upward by using the other end as an axis. At this time, the elevating part 230 may rotate upward until the medium accumulated on the elevating part 230 makes contact with the second belt part 220 disposed above the elevating part 230. The medium in contact with the second belt part 220 may be conveyed through the second belt part 220 and may be unloaded through the second path R2. The elevating part 230 may be driven by a separate driving source, for example, a motor. The motor may raise or lower the elevating part 230 by rotating the elevating part 230 about the other end of the elevating part 230 as an axis.

The second belt part 220 may define the second path R2 through which the medium is unloaded. The second path R2 may be connected to the third path R3. The second belt part 220 may be provided with an upper second belt part 221 disposed on the upper side, and a lower second belt part 222 disposed below the upper second belt part 221. The configuration of the second belt part 220 may be replaced with various configurations commonly used in the art for conveying a medium.

Meanwhile, the automated teller machine 1 according to one embodiment of the present invention may include a stopper 250 and a stack guide 240 to prevent the medium introduced into the elevating part 230 from leaving the accumulation space S.

The stopper 250 may be provided to penetrate the elevating part 230. For example, the stopper 250 may be provided to penetrate a through-hole formed in the elevating part 230. One end of the stopper 250 penetrating the elevating part 230 may be located in the accumulation space S. At this time, one end of the stopper 250 may make contact with the stack guide 240. Therefore, the front end of the medium introduced into the accumulation space S may collide with the stopper 250, and the medium may be accumulated in the accumulation space S defined by the elevating part 230, the stopper 250 and the stack guide 240.

The stack guide 240 may be provided on the upper side of the elevating part 230 to guide the medium introduced into the elevating part 230 along the movement path and to press the medium when the elevating part 230 moves up.

The stack guide 240 may include, for example, a hinge connection portion 242 rotatably coupled to a pivot shaft 241, and a pressing portion 243 rotatably coupled to one end of the hinge connection portion 242 to press the medium.

The pivot shaft 241 may be coupled to a frame 20*a* forming the outer appearance of the medium unloading part 60. The pivot shaft 241 may serve as a rotary shaft of the stack guide 240, and may be provided as, for example, a tubular shaft member.

One end of the hinge connection portion 242 may be rotatably hinged to the pivot shaft 241, and the other end of the hinge connection portion 242 may extend in a direction in which the elevating part 230 is provided.

The pressing portion 243 may be rotatably coupled to the other end of the hinge connection portion 242. The pressing portion 243 may make contact with the stopper 250 provided through the elevating part 230 before the elevating part 230 moves up. Therefore, the pressing portion 243 may cooperate with the elevating part 230 and the stopper 250 to define the accumulation space S in which the medium is accumulated.

A weight portion 243*a* may be provided at one end of the pressing portion 243. One end of the pressing portion 243 may be rotated downward by the weight portion 243*a*. The weight portion 243*a* may be formed by coupling a separate member such as a screw or the like to one end of the pressing portion 243 or by forming one end of the pressing portion 243 to be thicker than the other end thereof when forming the pressing portion 243.

A bent portion 243*b* may be provided at the other end of the pressing portion 243. The bent portion 243*b* may be provided by bending the other end of the pressing portion 243 bent toward the hinge connection portion 242. The bent portion 243*b* may make contact with the front end of the medium when the medium is introduced into the accumulation space S. The medium may be easily guided to the accumulation space S by the bent portion 243*b* bent upward into the accumulation space S.

In this regard, the hinge connection portion 242 may be connected to the pressing portion 243 between the weight portion 243*a* and the bent portion 243*b*. At this time, the pressing portion 243 is provided such that one end side thereof provided with the weight portion 243*a* is heavier than the other end side provided with the bent portion 243*b* about the portion of the pressing portion 243 to which the hinge connection portion 242 is connected. Therefore, one end of the pressing portion 243 may be rotated downward, i.e., toward the side on which the elevating part 230 is provided. Therefore, one end of the pressing portion 243 may make contact with the stopper 250 before the elevating part 230 moves up, and may press the medium when the elevating part 230 moves up. As such, the pressing portion 243 may be provided to guide the movement of the medium and to press the medium.

The guide portion 30 may be coupled to the body portion 20. One end of the guide portion 30 may be coupled to both side surfaces of the body portion 20, and the other end of the guide portion 30 may protrude to the outside of the body portion 20. The unloading unit 50 may be slidably inserted into the guide portion 30. Guide slits 31 may be formed on both side surfaces of the guide portion 30 so as to guide the sliding movement of the unloading unit 50. Guide protrusions 530 of the unloading unit 50 may be inserted into the guide slits 31, whereby the unloading unit 50 can slide in a corresponding relationship with the shape of the guide slits 31. At this time, the guide slits 31 may be formed in the longitudinal direction to extend from one end of the guide portion 30 toward the other end. Therefore, the unloading unit 50 can slide in the longitudinal direction of the guide portion 30.

Meanwhile, at least a portion of the guide slits 31 formed on one side surface of the guide portion 30 may be convexly bent upward to form a bent portion 31*a*. Therefore, when the unloading unit 50 slides, the unloading unit 50 may initially move upward along the bent portion and then descend to move in the longitudinal direction of the guide portion 30. By forming the bent portion 31*a* as described above, it is possible to prevent collision between a member provided inside the unloading unit 50 and a member provided inside the body portion 20 when the unloading unit 50 slides.

The unloading unit 50 may be slidably coupled to the guide portion 30, and the guide protrusions 530 inserted into the guide slits 31 to move along the guide slits 31 may be provided on both side surfaces of the unloading unit 50.

A hook portion 520 may be provided at one end of the unloading unit 50. The hook portion 520 may be detachably coupled to locking members 20*b* of the body portion 20. Therefore, when the hook portion 520 is fastened to the locking members 20*b*, the sliding movement of the unloading unit 50 may be limited. When the hook portion 520 is separated from the locking members 20*b*, the unloading unit 50 may slide.

The hook portion 520 may include, for example, a shaft member 521 rotatably connected at both ends to the inner surfaces of the unloading unit 50, hooks 522 provided at both ends of the shaft member 521 and rotated together with the shaft member 521 during rotation of the shaft member 521 so as to be fastened to or separated from the locking members 20*b*, and a grip portion 523 fixedly coupled to the shaft member 521 and gripped by the user to rotate the shaft member 521. In addition, the hook portion 520 may further include an elastic member 524 that applies a rotational force so that the shaft member 521 maintains a constant position. The elastic member 524 may be provided as, for example, a torsion spring.

The user may slide the unloading unit 50 by rotating the shaft member 521 and separating the hook portion 520 from the locking members 20*b* while holding the grip portion 523.

The unloading unit 50 may be provided with the third belt part 510 for unloading the medium introduced from the second belt part 220. The second belt part 220 and the third belt part 510 may form continuous media movement paths R2 and R3 on the upper side of the first belt part 210. In other words, the second movement path R2 and the third movement path R3 may be connected at the upper side of the first belt part 210. Accordingly, the second movement path R2 and the third movement path R3 may include a portion overlapping with the first movement path R1.

The third belt part 510 may include an upper third belt part 511 and a lower third belt part 512. At least a portion of the third belt part 510 may be provided to overlap with the second belt part 220 in the vertical direction before the unloading unit 50 slides (see FIG. 3). For example, an end portion of the upper third belt part 511 may be provided to overlap with the lower second belt part 222 in the vertical direction. As used herein, the term "vertical direction" may mean an up/down direction in FIG. 3.

Meanwhile, when the fastening of the hook portion 520 of the unloading unit 50 and the locking members 20*b* is released, the unloading unit 50 may slide forward (see FIGS. 4 and 5). When the unloading unit 50 slides forward, the unloading unit 50 may initially move up and move down due to the bent portion 31*a*, and may then slide. By allowing the unloading unit 50 to slide along these paths, it is possible to prevent the third belt part 510 and the second belt part 220 from colliding with each other during the sliding movement of the unloading unit 50.

In the state in which the unloading unit 50 slides forward, a separation space P may be formed between the second belt part 220 and the third belt part 510. At this time, the first belt part 210 may be exposed to the outside through the separation space P formed between the second belt part 220 and the third belt part 510. Therefore, when the medium is jammed in the first belt part 210, the user may remove the jammed medium by causing the unloading unit 50 to slide forward and then approaching the first belt part 210 through the separation space P.

As described above, in the case of the automated teller machine according to one embodiment of the present invention, the unloading unit 50 is provided so as to be slidable. Therefore, it is possible to easily remove the medium when the medium is jammed in the movement path.

While the invention has been shown and described with respect to the embodiments, the present invention is not limited thereto. It will be understood by those skilled in the art that various changes and modifications may be made without departing from the scope of the invention as defined in the following claims.

What is claimed is:

1. An automated teller machine, comprising:

a frame on which a first belt part and a second belt part for conveying a medium are provided; and an unloading unit slidably coupled to the frame and provided with a third belt part for unloading the medium conveyed from the second belt part, wherein the second belt part and the third belt part are configured to form a continuous medium movement path above the first belt part, a separation space is formed between the second belt part and the third belt part in a state in which the unloading unit is slid forward, and the first belt part is exposed to an outside of the automated teller machine through the separation space.

2. The machine of claim 1, wherein the frame includes:

a body portion in which the first belt part and the second belt part are provided; and a guide portion coupled at one end of the guide portion to both side surfaces of the body portion and protruding at the other end of the guide portion to an outside of the body portion, the guide portion having guide slits formed on both side surfaces of the guide portion.

3. The machine of claim 2, wherein the unloading unit is inserted into and slidably coupled to the guide portion, and includes guide protrusions provided on both side surfaces of the unloading unit and inserted into the guide slits to move along the guide slits.

4. The machine of claim 2, wherein the guide slits extend in a longitudinal direction of the guide portion, and at least a portion of each of the guide slits is convexly curved upward at one end side of the guide portion.

5. The machine of claim 2, wherein locking members are provided to protrude from both inner surfaces of the body portion, and a hook portion detachably coupled to the locking members is provided at one end of the unloading unit.

6. The machine of claim 5, wherein the hook portion includes:

a shaft member rotatably connected at both ends to the inner surfaces of the unloading unit;

hooks provided at both ends of the shaft member and rotated together with the shaft member during rotation of the shaft member to be fastened to or separated from the locking members; and a grip portion fixedly coupled to the shaft member.

7. The machine of claim 6, wherein the hook portion further includes an elastic member configured to apply a rotational force so that the shaft member maintains a constant position.

8. The machine of claim 1, wherein at least a portion of the third belt part is provided to overlap with the second belt part when seen in a vertical direction of the automated teller machine before a sliding movement of the unloading unit, and the third belt part is provided so as to be spaced apart from the second belt part after the sliding movement of the unloading unit.

9. The machine of claim 1, wherein the frame further includes an elevating part in which the medium passing through the first belt part is accumulated, and the medium introduced into the first belt part is accumulated in the elevating part and then unloaded through the second belt part and the third belt part.

10. The machine of claim 9, wherein the elevating part is rotatable upwardly and downwardly, and is configured to rotate upwardly to guide the medium to the second belt part when the accumulation of the medium introduced along the first belt part is completed.

11. The machine of claim 1, further comprising:

at least one cassette configured to store the medium; and a cassette module configured to supply the medium to the frame.

* * * * *